US005511770A

United States Patent [19]

Okazaki

[11] Patent Number: 5,511,770

[45] Date of Patent: Apr. 30, 1996

[54] SHEET MEDIA HANDLING SYSTEM WITH INTERRELATED INPUT ALIGNMENT AND OUTPUT SUPPORT

[75] Inventor: Sandra Y. Okazaki, Vancouver, Wash.

[73] Assignee: Hewlett-Packard Company, Palo Alto, Calif.

[21] Appl. No.: 311,084

[22] Filed: Sep. 23, 1994

[51] Int. Cl.[6] ..... B65H 5/22

[52] U.S. Cl. ..... 271/4.01; 271/171; 271/225; 271/3.14; 400/625

[58] Field of Search ..... 271/4.01, 4.08, 271/4.07, 4.1, 3.14, 10.12, 226, 233, 234, 239, 248, 253, 254, 255, 171, 207, 209, 223; 400/625, 630, 633, 633.1, 633.2; 346/25, 134

[56] References Cited

U.S. PATENT DOCUMENTS

| | | | |
|---|---|---|---|
| 4,728,963 | 3/1988 | Rasmussen et al. | 346/25 |
| 4,794,859 | 1/1989 | Huseby et al. | 101/485 |
| 5,031,894 | 7/1991 | Bedzyk et al. | 271/248 |
| 5,226,743 | 7/1993 | Jackson et al. | 400/625 |
| 5,366,216 | 11/1994 | Ahlvin | 271/223 |
| 5,377,966 | 1/1995 | Ohmori | 271/4.01 |
| 5,419,548 | 5/1995 | Ueda et al. | 271/209 |
| 5,434,660 | 7/1995 | Yoshida et al. | 271/207 |

FOREIGN PATENT DOCUMENTS

| | | | |
|---|---|---|---|
| 1419508 | 12/1975 | United Kingdom | 271/171 |

*Primary Examiner*—H. Grant Skaggs

[57] ABSTRACT

A sheet media handling system is provided which includes an input tray, an output tray, and an alignment mechanism capable of aligning sheet media which is to be input and supplementing support of sheet media once it has been expelled. The alignment mechanism thus employs an upstanding member which defines the length (or width) of the input tray, and which extends upwardly to supplement support of sheets within the output tray.

18 Claims, 2 Drawing Sheets

SHEET MEDIA HANDLING SYSTEM WITH INTERRELATED INPUT ALIGNMENT AND OUTPUT SUPPORT

TECHNICAL FIELD

The present invention relates generally to the handling of sheet media used in connection with sheet processors, and more particularly, to a system having input media alignment mechanism which provides enhanced output media support. More particularly still, the invention concerns a system which provides for the modification of output media support by adjusting input tray size. Although the invention has utility in a variety of sheet processing machines, it has proven particularly well suited for use in an single-sheet printer, and is described in that context below.

BACKGROUND ART

In a conventional single-sheet printer, media is directed through a print cycle which includes picking up a sheet from an input tray, feeding it through the printer, and then expelling it through the printer's output port. Once expelled, sheets fall to an output tray where consecutive sheets are piled one on top of the other so as to form an output stack. Ideally, the sheets fall directly to the output tray, forming a packet of vertically aligned sheets which is stable and easily manipulable.

Sheets expelled by conventional printers, however, rarely fall into an aligned vertical stack. Instead, sheets fall in a somewhat random fashion due to a variety of aerodynamic forces which produce an effect known generally in the industry as "sail". Such sail is most often characterized by a sheet cutting through the air so as to glide in the direction of sheet expulsion, and potentially pass beyond the confines of the output tray. This effect can result in an increasingly destabilized stack, often culminating in sheets spilling onto the floor and requiring that the sheets be restacked by hand.

In the past, the problem of sheet sail has been addressed using a pair of so-called anti-sail wings which act as intermediate sheet support upon expulsion of a sheet. Once the sheet has been fully expelled, the wings are moved oppositely, releasing the sheet in rear-biased fashion so as to allow the sheet to fall more directly to the output tray without the extent of forward momentum which would otherwise exist. Sheets thus fall to define a generally vertical output stack. An arrangement of the type just described is disclosed in U.S. Pat. No. 5,324,020 which is entitled "Paper Stacking System For Printers" and which is commonly owned herewith. The disclosure of that patent is incorporated herein by this reference.

Although the aforementioned system has proven effective in reducing sheet sail, there remains room for improvement. For example, very little has been done to compensate for variations in sheet media size, or for corresponding variations in sail characteristics due to such differently sized sheets. Conventional printers also have failed to efficiently address the problem of progressive stack destabilization, a phenomenon which is related to the posture of expelled sheets within the printer's output tray. Most printers simply employ an output tray with a floor which is sized to support the largest permissible sheet (generally 8½×14-inch). This has involved the use of a large output tray floor which underlies a substantial portion of output sheets, significantly increasing the cost to manufacture, and obstructing access to the printer's input tray. It thus would be desirable to provide a sheet media handling system which reduces the output tray's size, but improves output media support. More particularly, what is needed is a small size output tray which readily is adapted to address variations in output sail characteristics due to changes in sheet media size.

DISCLOSURE OF THE INVENTION

The invented system addresses these problems by provision of a sheet alignment mechanism which includes an upstanding member configured both to vary input tray size and to adjust output tray support. The system employs upper and lower sheet media support structures, the lower support structure serving as the printer's input tray and the upper support structure serving as the printer's output tray. The upstanding member is movably mounted on the lower support structure, defining what amounts to an adjustable input tray wall. By varying the size of the input tray, sheets may be aligned within the input stack. The upstanding member also serves to supplement support of expelled sheet media, the member extending upwardly to engage the undersurface of the output stack. Preferably, the upstanding member extends above the level of the output support structure, and is positioned to support the output stack adjacent its forward edge so as to place the output stack in an anti-sail posture. Thus, as the upstanding member is adjusted to accommodate different sizes of input media, output support is similarly adjusted to ensure an anti-sail posture of the output stack.

These and additional objects and advantages of the present invention will be more readily understood after a consideration of the drawings and the detailed description which follows.

DETAILED DESCRIPTION OF THE PREFERRED EMBODIMENT AND BEST MODE OF CARRYING OUT THE INVENTION

Figure 1:
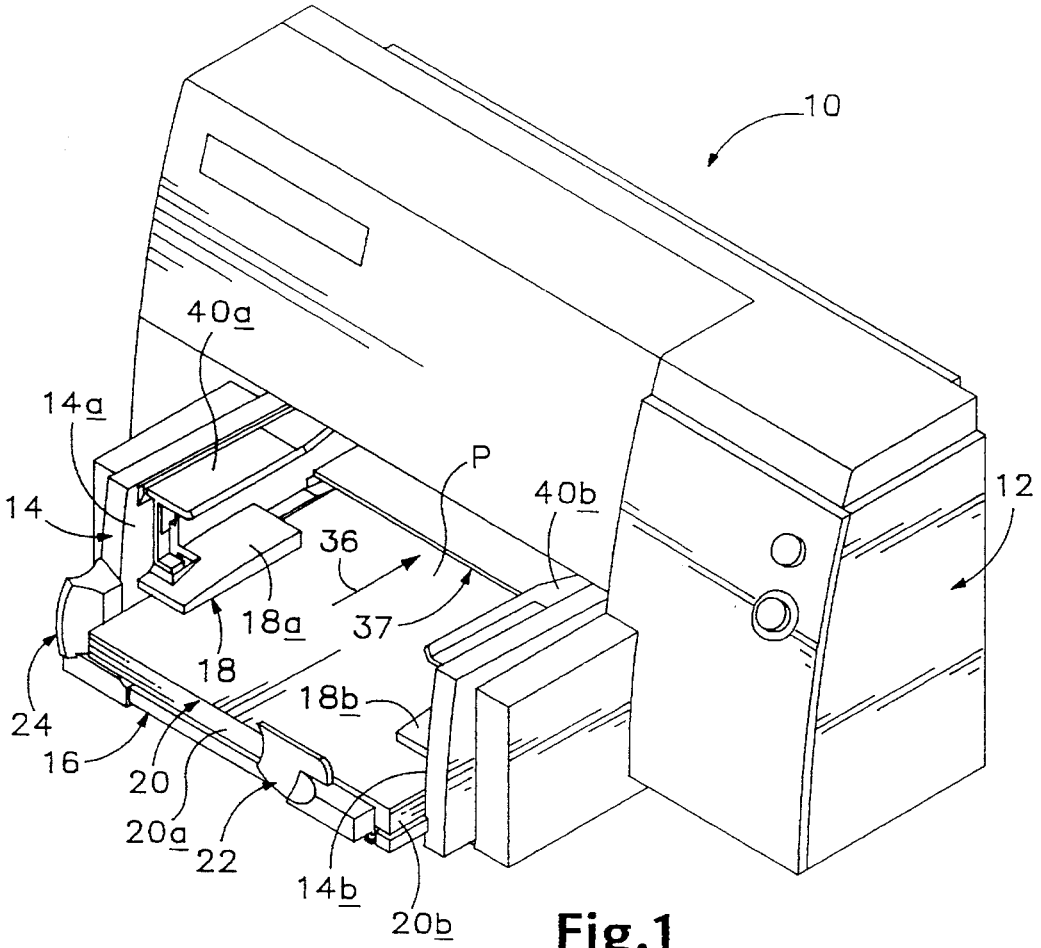
FIG. 1 is an isometric view of a single-sheet printer, such printer incorporating a sheet media handling system constructed in accordance with the present invention.

FIG. 1 shows, at 10, a sheet processor in the form of a somewhat typical single-sheet printer, such printer including a chassis 12 and an input/output sheet cassette 14. The cassette includes upper and lower sheet media support structures, the lower structure 16 being configured to support sheets prior to input, and the upper structure 18 being configured to support sheets which have been expelled. The lower support structure thus serves as the printer's input tray, and the upper support structure serves as the printer's output tray. The printer thus will be understood to operate conventionally, sheets being picked up from an input tray, printed on and expelled to an output tray.

Input tray 16 supports sheets for delivery to the printer's print mechanism (not shown), the input tray employing a generally planar input floor **16*a* which spans the distance between surfaces 14***a*, 14*b*. Surfaces 14*a*, 14*b* nominally define opposite side walls of the cassette, and thus define the maximum possible sheet media width. The sheets are aligned in the input tray using an alignment mechanism which adjusts the effective length and width of the input tray. Output tray 18 supports sheets which have been expelled after printing. Unlike the input tray, however, the output tray defines a pair of relatively small, generally horizontal output floor sections 18*a*, 18*b*, and may include an additional floor section adjacent chassis 12. Additional sheet support is provided by the alignment mechanism as will be described below. Cassette 14 thus will be understood to serve as a sheet media handling system which holds sheets both prior to input, and once they have been dispelled.

Sheets initially are placed on the floor of the input tray, the sheets being arranged in what is referred to hereinafter as an input stack 20. In accordance with the invention, input stack 20 is aligned using a sheet alignment mechanism, such mechanism including a first upstanding member 22 and a second upstanding member 24. The first upstanding member engages the outwardmost (or forwardmost) edge 20*a* of the input stack so as to align sheets lengthwise in the input tray. The second upstanding member engages a side edge of the stack (such as the edge opposite to edge 20*b*) so as to align sheets widthwise in the input tray. FIG. 1 illustrates an input stack which is so-aligned.

Figure 2:
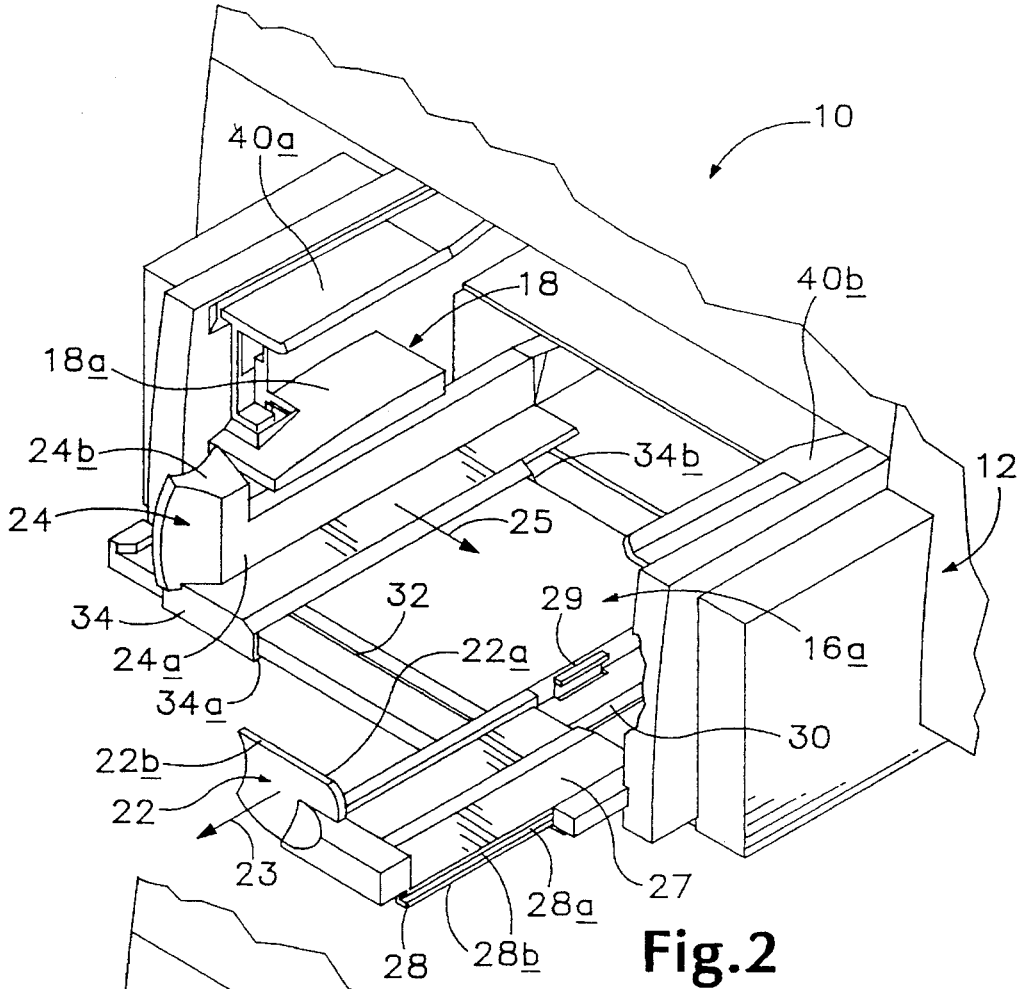
FIG. 2 is a fragmented isometric view of the printer depicted in FIG. 1, but with the sheet media removed to illustrate adaptability of the system.

In FIG. 2, cassette 14 is shown with the input stack removed so as to provide a detailed illustration of the depicted alignment mechanism. Upstanding member 22, for example, will be seen to include a generally vertical input-adjustment region 22*a* which is configured to engage the outwardmost edge of the input stack, thereby defining the length of the input tray. Upstanding member 24 similarly includes a generally vertical input-adjustment region 24*a* which engages a side edge of the sheet stack so as to define the width of the input tray. Region 24*a*, it will be noted extends substantially the length of the input tray.

Upon comparing FIGS. 1 and 2, it will be noted that the upstanding members are movable, the first upstanding member 22 being movable as indicated at 23, and the second upstanding member 24 being movable as indicated at 25. The first upstanding member thus sill be understood to provide for modification of the input tray's length, and the second upstanding member will be understood to provide for modification of the input tray's width. Each member thus provides for alignment of sheets in the input stack.

As indicated, member 22 rides on an elongate carriage 27 which moves toward and away from the printer chassis along a predetermined path. The path is defined by tracks (such as that shown at 29), the carriage being fitted with corresponding track followers (such as that shown at 28) which restrict carriage movement to an axis which extends parallelly to arrow 23. The track followers thus include ribs 28*b* which define a slot 28*a* sized to capture the tracks. Further guide structures (such as track 30) similarly may be used to enhance control of carriage 27. Member 22, in conjunction with carriage 27, is identified as a length adjuster, referring to its use to adjust the input tray's length.

Member 24 similarly rides on an elongate carriage 34, such carriage being associated with the input tray to define the input tray's effective width. The width adjuster carriage rides on track 32, carriage 27 being fitted with a corresponding track follower (not shown). Tabs 34*a* and 34*b* further define the movement of carriage 34 relative to the input tray. Member 24, in conjunction with carriage 34, is identified as a width adjuster, referring to its use to adjust the input tray's width.

Although the preferred embodiment employs tracks which are incorporated into the input tray floor, those skilled will appreciate that an alternative track arrangement may be used. For example, tracks may be mounted to chassis 12, side wall 14*b*, or to some other structure associated with the input tray.

Figure 3:
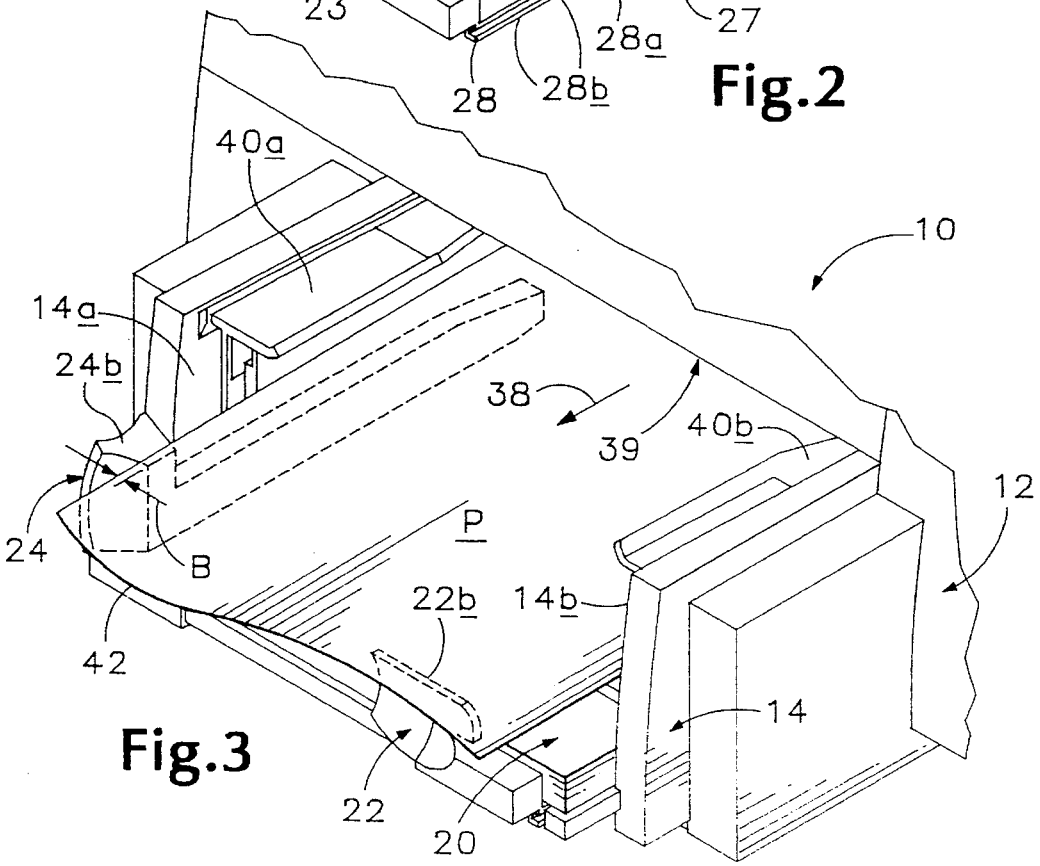
FIG. 3 is a fragmented isometric view of the printer depicted in FIG. 1 with an expelled sheet P supported in an anti-sail posture.

Turning now to FIG. 3, it will be appreciated that the length and width adjusters serve dual purposes, each acting both to align sheets which are to be input and to supplement support of sheets which have been expelled. Although output sheets are supported by the output tray, support is enhanced by the alignment mechanism, expelled sheets being supported in an anti-sail posture so as to provide for a more stable stack. Supplemental support may be provided using a pair of upstanding members as shown, but alternatively may be provided by a single upstanding member which is positioned to engage the center of the input stack's outwardmost edge.

In accordance with one of the principal features of the invention, length adjuster 22 extends upwardly from the input tray. The length adjuster thus extends at least to the level of the output tray, a generally horizontal output-support region 22*b* being provided to engage the undersurface of any sheets stacked within the output tray. The input and output stacks are slightly offset in the direction of sheet media outflow, the length adjuster thus being configured to support the output stack adjacent its outwardmost (or forwardmost) edge 42.

Width adjuster 24 similarly extends upwardly to the level of the output tray floor, further supplementing output sheet support. A generally horizontal output support region 24*b* engages the undersurface of any sheets within the output tray. The input and output stacks also are slightly laterally offset, the width adjuster being configured to support the output stack adjacent a side edge of the stack. Preferably, width adjuster 24 will support the forwardmost portion of the output stack's side edge.

Figure 1A:
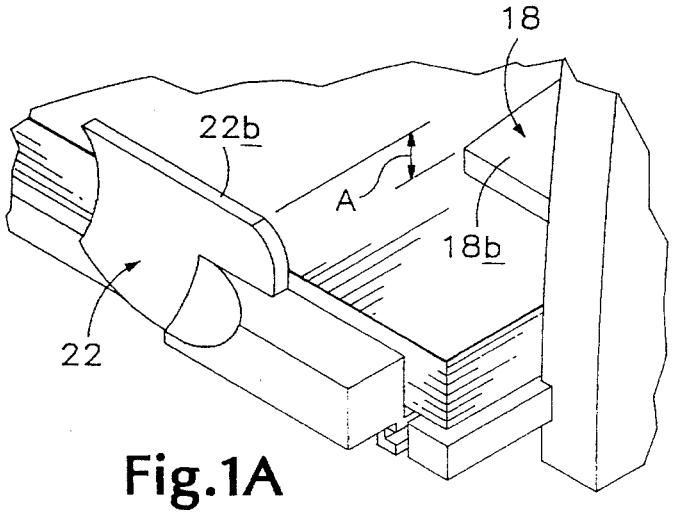
FIG. 1A is an enlarged isometric fragment of the printer depicted in FIG. 1, such fragment illustrating the relative levels of output media support.

As best indicated in FIG. 1A, the length adjuster extends to a level just above the level of the output tray's floor, thereby raising the outwardmost edge of the output stack relative to its opposite inwardmost edge, and placing the output sheets in a posture which opposes sheet sail. In the preferred embodiment, the length adjuster extends a distance A above the level of output tray floor 18*b*, such distance being on the order of approximately 5-millimeters. The width adjuster similarly extends upwardly to terminate at an elevation which is approximately 5-millimeters above the level of the output tray floor. The outwardmost edge of the output stack thus is raised relative to the rest of the stack, effectively opposing sheet sail. The anti-sail posture just described is best illustrated in FIG. 3.

Upon changing input media size, the length and width adjusters are changed, and correspondingly, the support provided to expelled sheets is changed. It will therefore be appreciated that the support provided by the alignment mechanism is closely related to the input media size. With each change in input media size, there will be a corresponding change in output support so as to minimize sail of the output stack.

Operation

A print cycle begins with a sheet P being picked up from the input tray, and fed into the printer's input port 37 in the direction indicated at 36 (FIG. 1). The sheet is then printed on, and is expelled through an output port 39 in the direction indicated at 38 (FIG. 3). The input and output ports are vertically stacked, the input port being at approximately the level of the input tray, and the output port being above the level of the output tray.

Upon expulsion, sheets are passed to a pair of wings 40*a*, 40*b* which extend horizontally at a level approximating the level of the printer's output port. The wings are spaced so as to provide temporary support for expelled sheets and are retractable, so as to allow the sheets to fall onto the output tray. In the preferred embodiment, the wings are pivotably mounted to side walls 14*a*, 14*b* such that the wings pivot toward a retracted position against the walls. In this retracted position, the wings no longer support expelled sheets. Sheets are thus allowed to fall into the output tray upon retraction of the wings. Thereafter, the wings are moved back to the positions indicated in the drawings so as to provide for temporary support of the next-expelled sheet.

In order to further improve output stack support characteristics, expelled sheets may be biased to fall toward side wall 14*a*, such bias tending to enhance width adjuster contact. In FIG. 3, for example, it will be noted that the sheet P has been biased toward width adjuster 24. Such bias may be achieved in a variety of ways, but is preferably accomplished simply by retracting output support wing 40*a* earlier than wing 40*b*. This causes the sheet to pass toward side wall 14*a*, and thus toward the width adjuster in order to enhance sheet support. The sheet thus overlaps surface 24*b* by a distance B. Distance B preferably is on the order of at least 3-millimeters.

Industrial Applicability

The invented sheet media handling system is useable in virtually any sheet processor wherein sheets are to be input and output through vertically stacked ports. The system provides for single action adjustment of both input tray size and output sheet support. Because such output support is adjustable according to sheet size, it will be appreciated that less raw material is needed to manufacture the output tray, and thus manufacture and efficiency is improved. Additionally, operators are provided with simpler adjustment mechanisms, and with improved access to the input tray.

While the present invention has been shown and described with reference to the foregoing operational principals and preferred embodiment, it will be apparent to those skilled in the art that various changes in form and detail may be made without departing from the spirit and scope of the invention as defined by the claims.

I claim:

1. A sheet media handling system for use in a sheet processor having vertically-stacked input and output ports, said handling system comprising:

a lower support structure configured to support sheets for delivery to the sheet processor's input port;

an upper support structure at a predetermined level above said lower support structure, said upper support structure being configured to at least partially support sheets expelled outwardly from the sheet processor's output port; and an alignment mechanism including an upstanding member which is adjustable independently of said upper support structure to align sheets supported by said lower support structure, said upstanding member extending upwardly to at least said predetermined level to supplement support of expelled sheets by said upper support structure.

2. The handling system of claim 1, wherein said lower support structure directly underlies said upper support structure.

3. The handling system of claim 1, wherein said upstanding member automatically is positioned to supplement support of expelled sheets adjacent their outwardmost edges upon adjustment of said upstanding member to align sheets within said lower support structure.

4. The handling system of claim 1, wherein said upstanding member extends upwardly beyond said predetermined level of said upper support structure.

5. The handling system of claim 1, wherein said upstanding member extends upwardly from said lower support structure to approximately 5-millimeters beyond said predetermined level of said upper support structure.

6. The handling system of claim 1, wherein said upstanding member is positionable to engage outermost edges of sheets supported by said lower support structure to align the sheets lengthwise.

7. The handling system of claim 1, wherein said upstanding member is positionable to engage side edges of sheets supported by said lower support structure to align the sheets widthwise.

8. The handling system of claim 1 wherein said expelled sheets are biased toward engagement with said upstanding member.

9. The handling system of claim 1 which further comprises a pair of wings configured to receive expelled sheets, at least one of said wings being movable to allow sheet media to fall off said wings and onto said upper support structure.

10. A sheet media handling system for use in a sheet processor having vertically-stacked input and output ports, said handling system comprising:

a lower support structure including a substantially horizontal input floor having a first length said input floor being configured to support a stack of sheets for delivery to the sheet processor's input port;

an upper support structure including a substantially horizontal output floor having a second length shorter than the first length, said output floor being positioned at a predetermined level above said input floor and configured to at least partially support sheets expelled outwardly from the sheet processor's output port; and an alignment mechanism which includes a first upstanding member selectively configurable independently of said upper support structure to engage an edge of the input stack to align the input stack lengthwise, said first upstanding member extending upwardly at least to said predetermined level so as to supplement support of expelled sheets adjacent their outwardmost edges.

11. The handling system of claim 10, wherein said first upstanding member extends upwardly from said input floor to approximately 5-millimeters above said output floor.

12. The handling system of claim 10, wherein said alignment mechanism further includes a second upstanding member which is positionable independently of said upper support structure to engage a side edge of the sheet stack to align sheets widthwise on said input floor, said second upstanding member extending upwardly at least to said predetermined level so as to further supplement support of expelled sheets.

13. The handling system of claim 12, wherein said second upstanding member extends upwardly from said input floor to approximately 5-millimeters above said output floor.

14. The handling system of claim 12 wherein said expelled sheets are biased toward engagement with said second upstanding member.

15. The handling system of claim 10 which further comprises a pair of wings configured to receive expelled sheets, at least one of said wings being movable to allow sheet media to fall off said wings and onto said output floor.

16. A sheet media handling system for use in a printer having vertically-stacked input and output ports, said handling system comprising:

an input floor which extends outwardly from adjacent said input port to support a stack of sheets for delivery to the printer's input port;

a stationary output floor positioned above said input floor, said output floor being configured to support sheets expelled outwardly from the printer's output port; and an upstanding member including a generally vertical input-adjustment region configured to selectively engage an edge of the sheet stack, said upstanding member extending upwardly to terminate in a generally horizontal output-support region which is above said output floor so as to support expelled sheets from below and thereby to position outward edges of output sheets higher than corresponding inward edges of output sheets, said upstanding member being adjustable independently of said output floor to supplement support of expelled sheets automatically based on input sheet size.

17. The handling system of claim 16, wherein said upstanding member is positionable to engage an outermost edge of the sheet stack to define a length of the input floor.

18. The handling system of claim 16, wherein said upstanding member is positionable to engage a side edge of the sheet stack to define a width of the input floor.

* * * * *